United States Patent [19]

Muller

[11] 4,310,092

[45] Jan. 12, 1982

[54] PHOTOGRAPHY SHOULDER BAG WITH A PIVOTAL LID

[76] Inventor: Christoph Muller, Kleiner Muristalden 26, CH-3006 Bern, Switzerland

[21] Appl. No.: 69,202

[22] Filed: Aug. 23, 1979

[30] Foreign Application Priority Data

Sep. 1, 1978 [DE] Fed. Rep. of Germany ..... 2838289

[51] Int. Cl.[3] ..... B65D 85/00

[52] U.S. Cl. ..... 206/578; 206/316

[58] Field of Search ..... 150/52 J; 206/578, 316; 211/87; 248/220.3

[56] References Cited

U.S. PATENT DOCUMENTS 2,348,620 5/1944 Grover ..... 206/578
2,665,801 1/1954 Berkman ..... 206/578
3,094,892 6/1963 Topf ..... 248/220.3 X
3,204,776 9/1965 Brown et al. ..... 211/87
3,910,470 10/1975 Swenson ..... 150/52 J X

FOREIGN PATENT DOCUMENTS 880999 6/1953 Fed. Rep. of Germany ..... 150/52 J

*Primary Examiner*—Donald F. Norton
*Attorney, Agent, or Firm*—Neuman, Williams, Anderson & Olson

[57] ABSTRACT

A photography case or bag is provided having an apertured wall on which discrete photograhic items may be releasably mounted by means of readily detachable securing means. The base has a pivotal cover or lid enabling the case contents to be readily exposed for use to the carrier of the bag by merely pivoting the cover into a nested position with the main case portion.

16 Claims, 29 Drawing Figures

PHOTOGRAPHY SHOULDER BAG WITH A PIVOTAL LID

This invention relates to a photography shoulder bag with a pivotal lid and more particularly pertaining to a bag having novel mounting means on an interior bag wall. A photography case of this kind, although not produced as a shoulder bag, is already known from Utility Model application No. 75 37 205 of the Federal Republic of Germany which was published Feb. 17, 1977.

In photography various accessories are used in addition to the camera itself. Normally, the photographer wishes to take with him at least one other lens in addition to the lens on the camera, either a telephoto lens and/or a wide-angle lens, as well as various filters, different films or even another camera. Photography cases have, therefore, come into use which accommodate all the photographic equipment. The photography cases are substantially box-shaped or case-like, and the individual items of photographic equipment or accessories are placed loosely in such photography case. Photography cases which are divided into compartments are known in the art, but in such cases as well, the separate items are laid in loosely.

In the known photography cases, therefore, the photographer can take with him all his photographic equipment, but a draw-back with these cases is that at least some of the individual objects in the photography case are relatively inaccessible. Thus, if the photographer wishes to change a lens he has to remove the photography shoulder case, place it on the ground or on a support, open the case, remove the lens from the camera and put it in the photography case, and then take the other lens out of the photography case and attach it to his camera. He must also take off or put on the relevant dust covers of the respective lenses. These manipulations are thus relatively laborious and time consuming. The photographer will, therefore, frequently, avoid changing the lens to bring into use a lens which is more suitable for the subject concerned than the lens then in place on the camera. Frequently, perhaps on a journey, there is simply no room and/or time for such manipulations. It is extremely difficult with prior art cases to undertake the changing of a lens with the photography case suspended on the shoulder of the photographer. Also, there is a danger that the various accessories will be damaged or soiled, or else even that various films will be mixed up.

Accordingly, this invention is directed to the problem of creating a photography case, in which all the items are held securely in their preordained places, and are accessible at all times after the photography case has been opened, thus they can be picked up by the free hand of the photographer and taken out of the photography case or put back in their place in the photography case.

According to this invention different items are thus not laid loosely in a box-shaped case, but they are each held in place in a predetermined position on an apertured surface spaced from the rear wall of the case, nearest to the body of the photographer. Such item retention is effected by means of a securing means which engages a receiving aperture. It is then possible to flip back the pivotal case lid about the pivot axis arranged at the case bottom, so that the items held on the rear wall are readily accessible to the hand of the case bearer-photographer.

The photography case is constructed in the form of two shell portions, and the hinge or pivot axis for the pivotal lid or cover is not provided on the upper edge or on the upper region of the front wall of the case, but on the lower portion of the case. When the pivotal lid is opened, therefore, the various items held on the rear wall of the case are accessible to the free hand of the photographer; they can be taken out or replaced. The cover does not have to be carried in a depending, open position wherein it would be a nuisance and could also be damaged, but the lid, which in the closed state forms nearly half of the volume of the photography case, can be pushed up behind the case rear wall.

Furthermore, according to the invention, for this purpose the side walls on the main part of the case are only approximately half as wide as the base wall, which is the full width of the case. The side walls which form the complementary case half width are provided by the lid. The cover pivot pins can each be displaced in a guideway constructed on the free edge of the case half side walls. Therefore, although the cover or lid has side walls which are half the width of the photography case itself, it has no base or floor and comprises the entire upper wall surface of the case. The base wall of the case is thus constructed entirely of the main part of the case. After pivoting downwardly the lid can be pushed up behind the rear wall of the case, whereby the pivot pins slide in the lateral guideways.

The "plug-in" connections for the various items to be carried in the case can be of any kind whatsoever, but a sheet with a grid of holes on the rear wall has proved particularly advantageous. In this way, the division of the space in the photography case is not fixed but is variable. The photographer can divide up the space according to his own wishes and in particular, to accommodate his own photographic equipment or the items of his photographic equipment which he wants to take in his photography case at any time. There are, therefore, various retention means for detachably holding any particular item; for example, the said retainer may have several pairs of gripper arms each for a film or a film case. However, these holders or retainers are not constructed in fixed positions in the photography case, or at least not all of them. Due to the sheet of holes the retainers for photography items can be attached as desired, and desired division of the available bag volume is therefore obtained. Of particular significance for this feature is an eccentric securing pin or rod which is inserted through a hole in the holder and an underlying hole in the apertured mounting sheet. The securing element engages via an eccentric arm at its rear end behind the edge of the hole in the apertured sheet while its head, which is equipped with a screwdriver slot or with a socket head, rests against the edge of the hole in the holder or the like which is to be secured. With this connecting element, which will be described in more detail with reference to the drawing, the desired variable division of case volume can be effected easily, despite which the items within the case are very securely held.

In a further embodiment of the invention, at least one holder for accommodating a spare lens is provided on the apertured mounting sheet. Furthermore, this "screw-in" holder has a pivotally mounted lens mounting portion which pivots relative to an anchor plate portion detachably mounted on the apertured sheet or panel defining the case inner wall. The pivotal lens mount can be locked between two different positions, namely, the normal downwardly facing storage position, and an oblique change-over position which is directed downwardly and outwardly. The photographer can thus lock the holder in the laterally oblique, outwardly facing positions in which the lens can be picked up easily for exchanging the lens; in this outwardly inclined position, however, the lens would project out laterally into the space in an inconvenient way, so the holder can be pivoted into the vertical storage position and locked therein.

In the following description an example of a photography case according to the invention and various versions of the disengageable securing means and retainers are described with reference to the drawing wherein.

Figure 5:
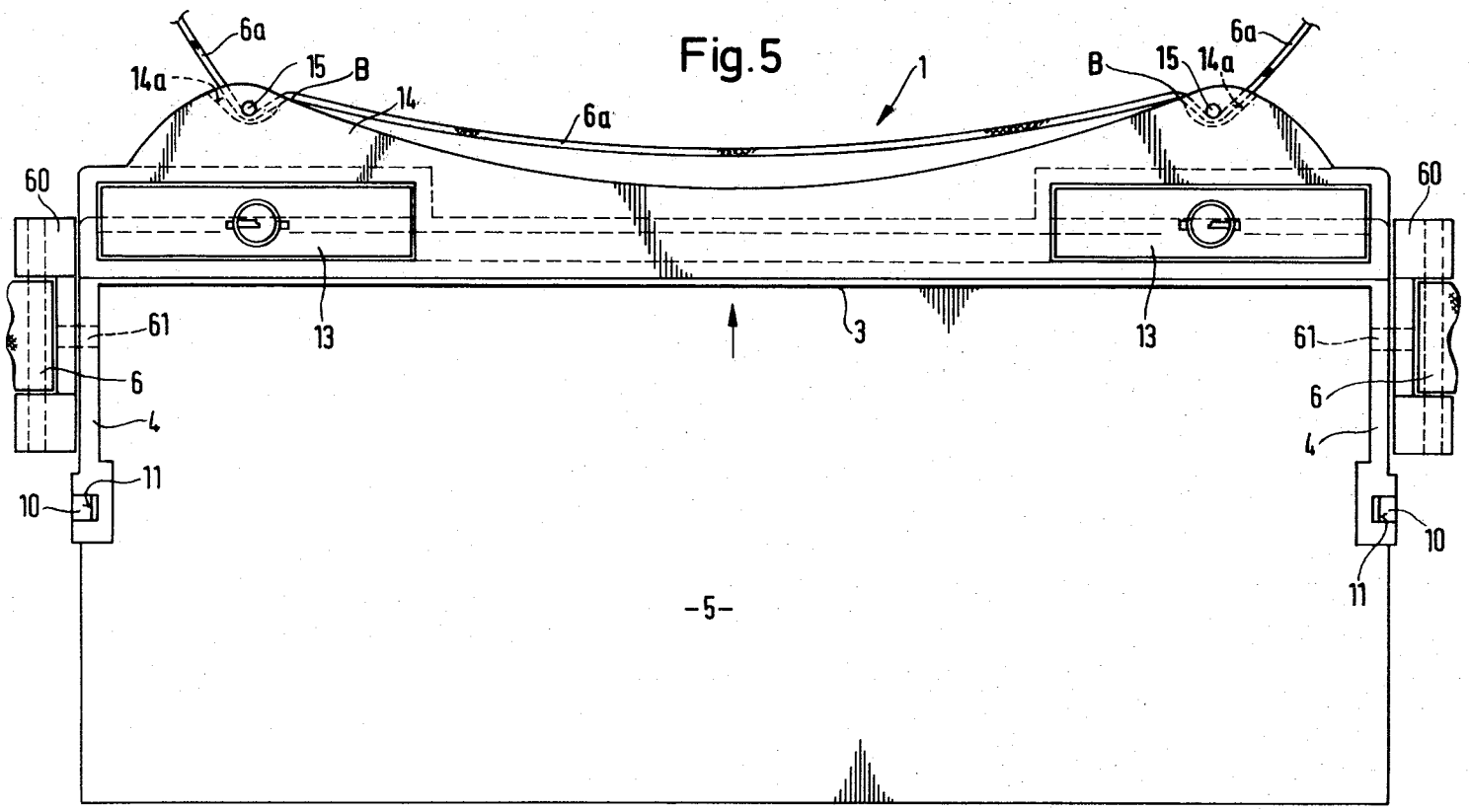

FIG. 5 comprises a bottom plan view of the main case part.

Figure 5A:
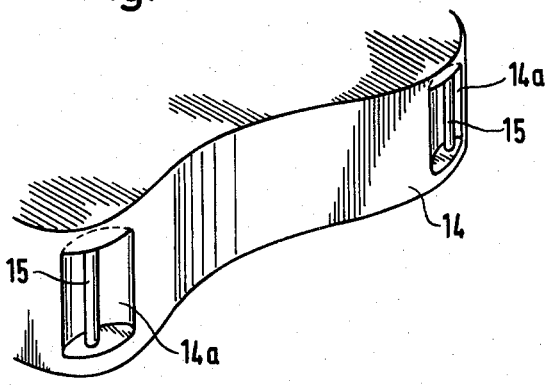

FIG. 5*a* illustrates a guideway for the waist strap of the provided case.

Figure 5B:
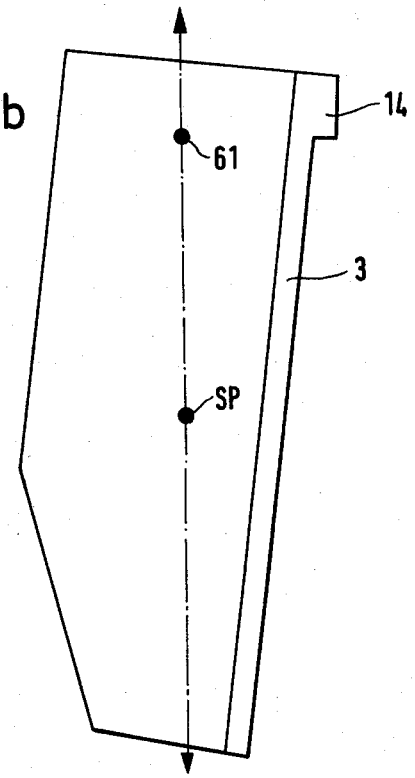

FIG. 5*b* is a schematic sketch showing the suspension of the case in the vertical plane.

Figure 1:
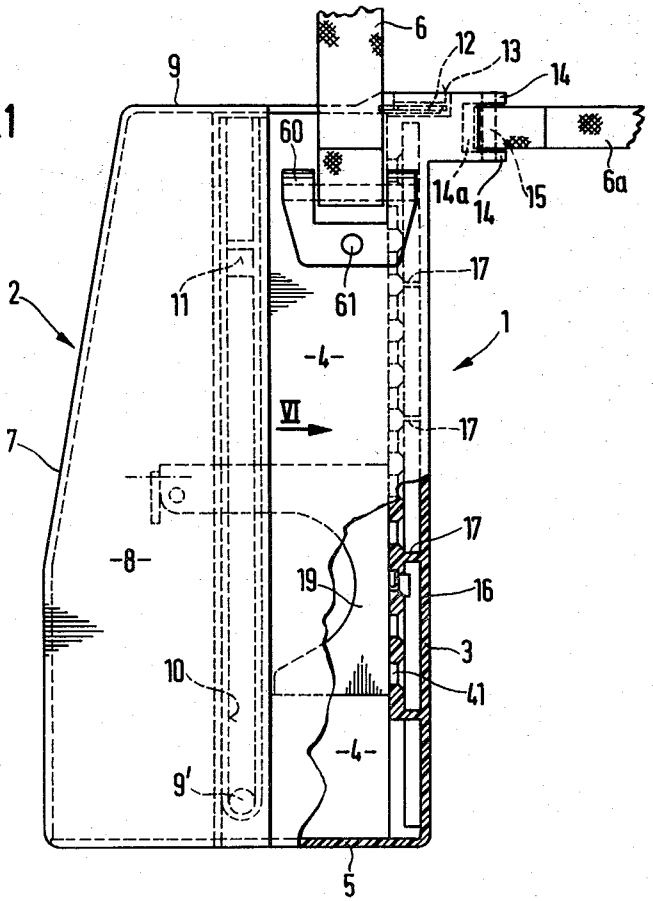
FIG. 1 shows a side view of a photography case according to the invention illustrated with the cover in a closed condition.
Figure 3:
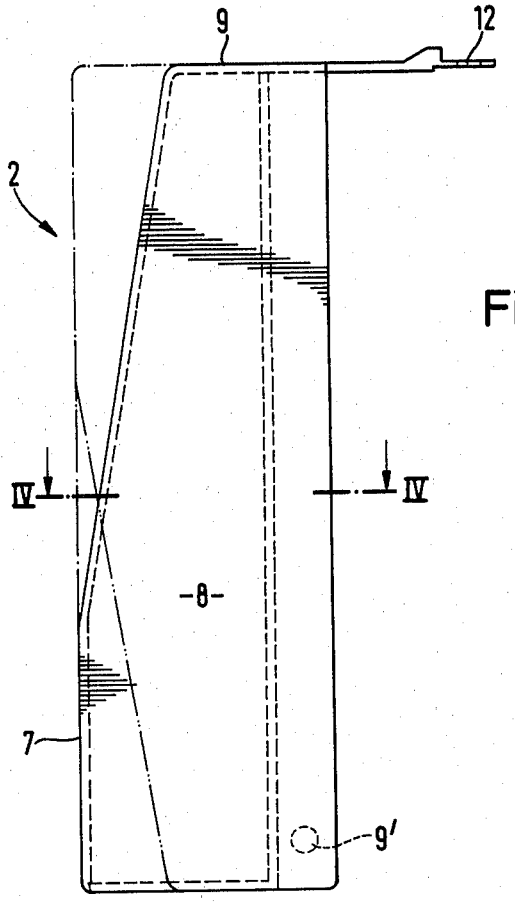
FIG. 3 shows the case lid in side elevation.
Figure 4:
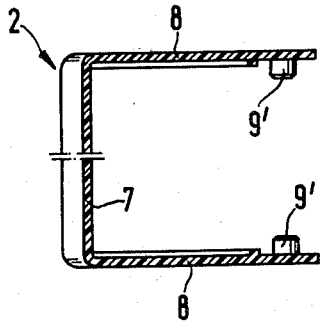
FIG. 4 shows the case lid in section taken along line IV—IV of FIG. 3.
Figure 6:
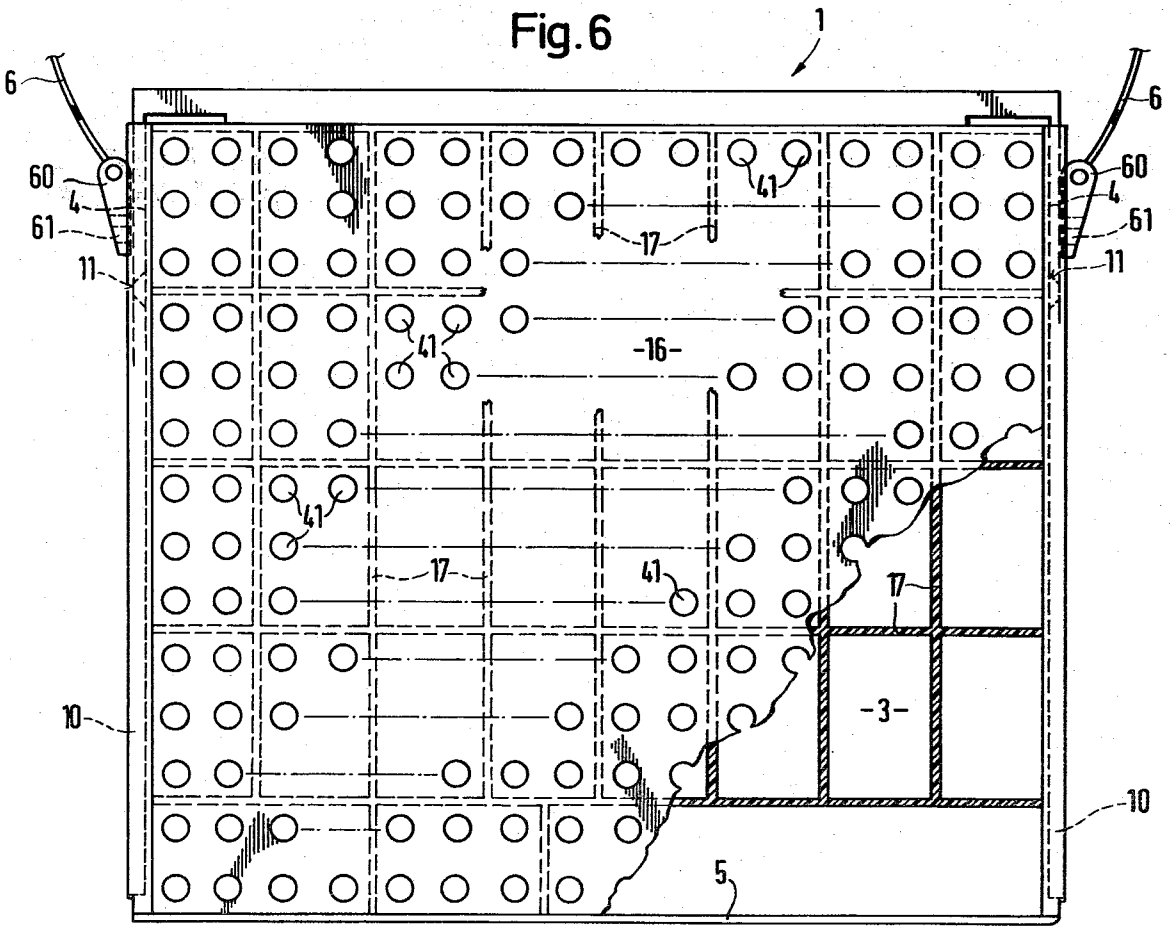

FIG. 6 shows the main case part in elevation, viewed in the direction of the arrow VI in FIG. 1 or FIG. 5, particularly the apertured mounting sheet mounted on the case rear wall.

Figure 8:
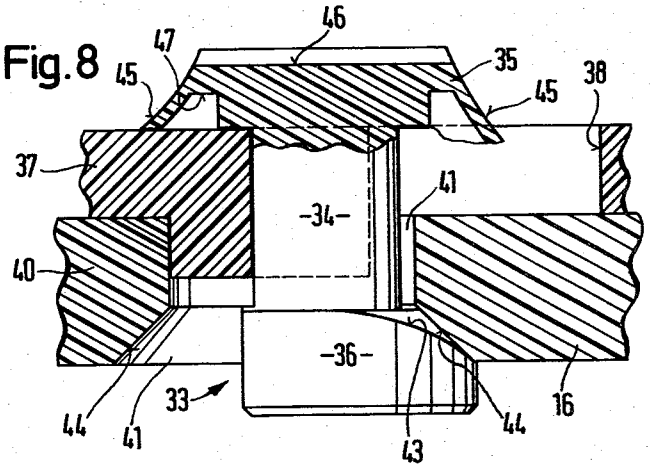
Figure 10:
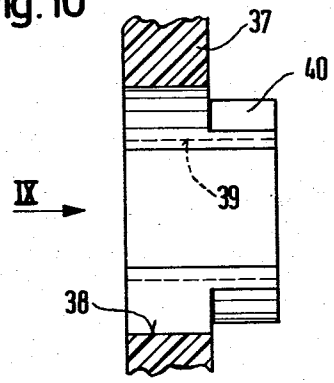
Figure 7:
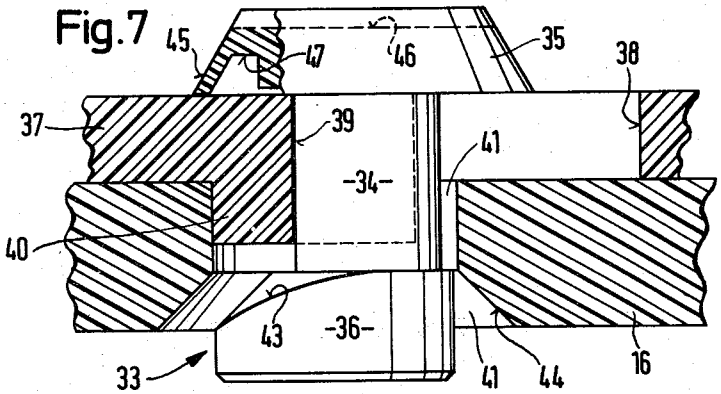
Figure 9:
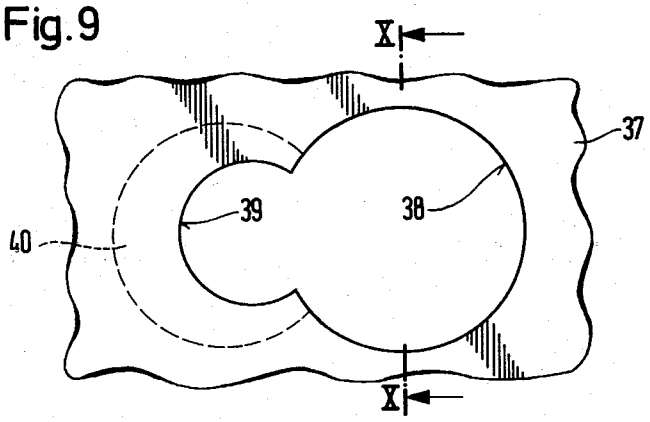

FIGS. 7 to 10 show a "plug-in" type connection according to the invention utilizing an eccentric securing pin, these being:

FIG. 7 is a sectional view of the eccentric pin pushed in before rotation;

FIG. 8 is a sectional view after rotation of the eccentric pin;

FIG. 9 comprises a plan view of the shaping of the plug-through hole on the item which is to be "plugged in" or mounted on the inner rear wall;

FIG. 10 is a sectional view along line X—X in FIG. 9.

Figure 11:
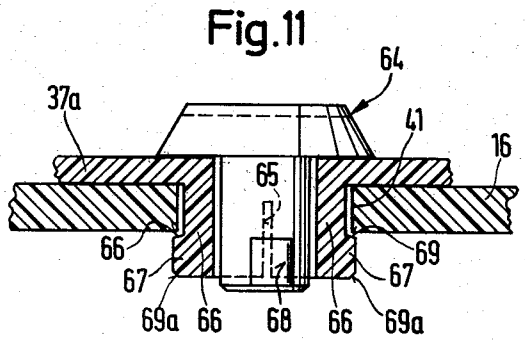

FIG. 11 illustrates another "plug-in" type connection utilizing a clamping pin in the pushed-in position.

Figure 12:
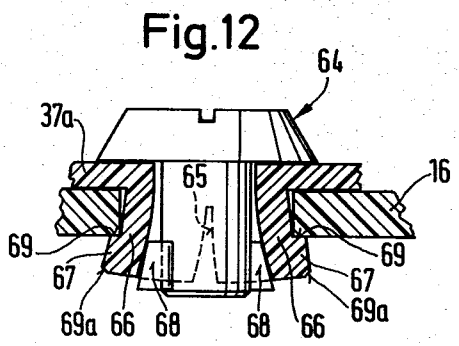

FIG. 12 illustrates the same "plug-in" connection with the clamping pin displaced through 90° into the clamping position.

Figure 13:
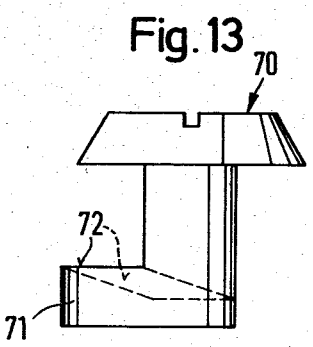

FIG. 13 illustrates a modified clamping pin i.e., a one-sided clamping pin.

Figure 13A:
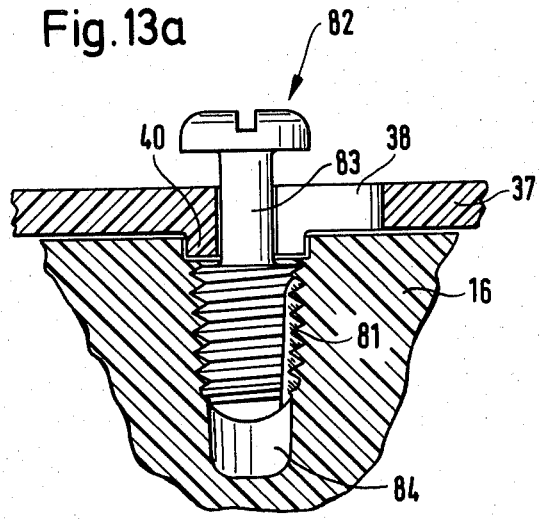

FIGS. 13*a, b, c* depict another "plug-through" type connection, the plug-through pins being equipped with a self-tapping thread section.

Figure 14:
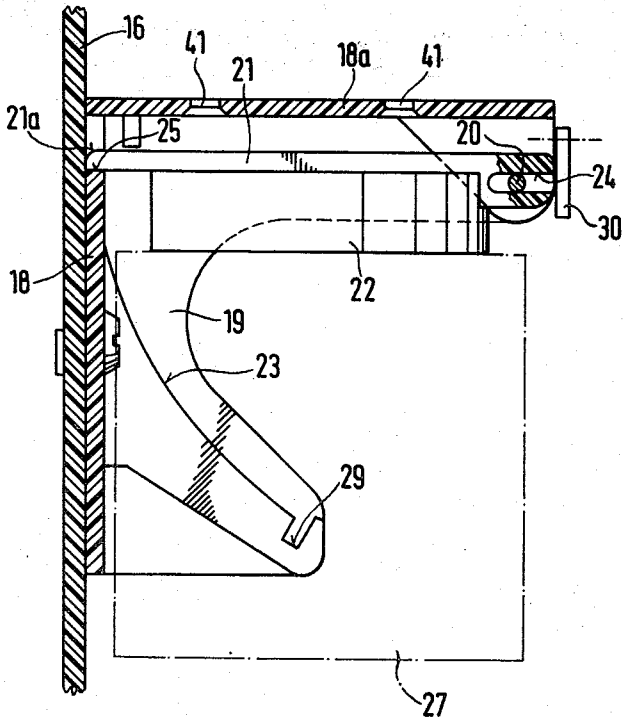

FIG. 14 is a vertical section taken perpendicular to the rear apertured mounting wall illustrating a lens holder in the lens-storing position.

Figure 15:
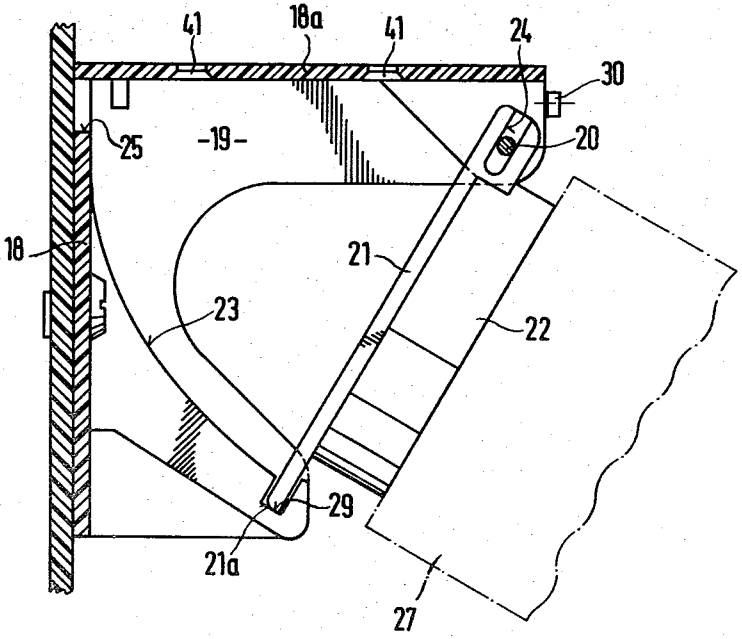

FIG. 15 illustrates the lens holder of FIG. 14 in the "change-over" position.

Figure 18:
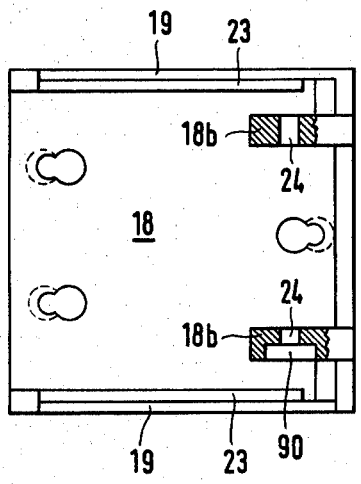
Figure 17:
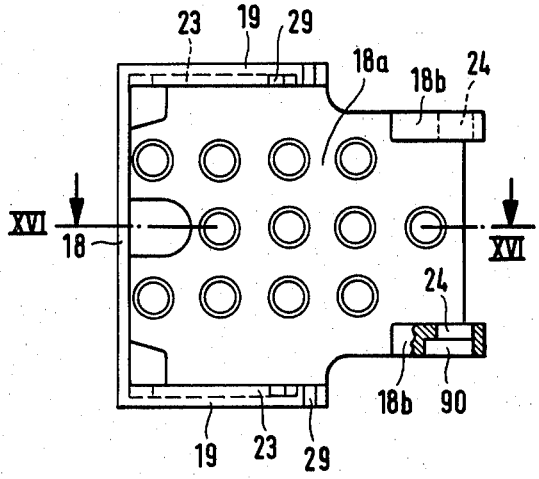
Figure 16:
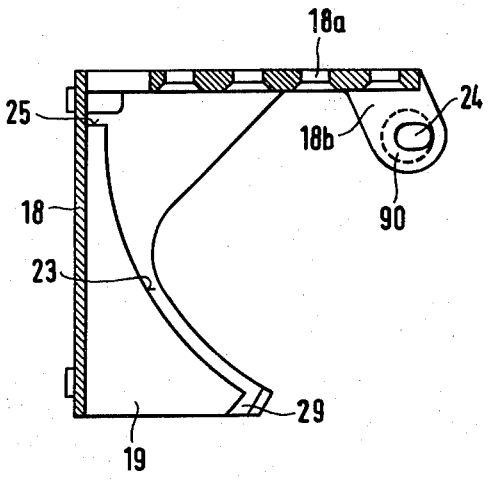
Figure 20:
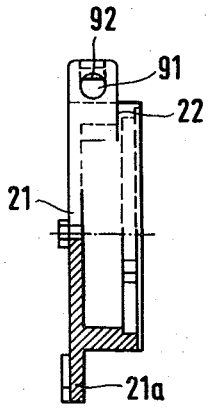
Figure 19:
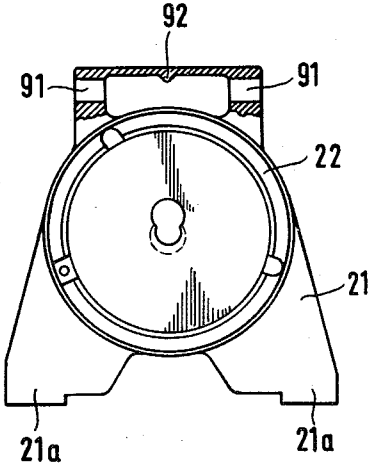
Figure 21:
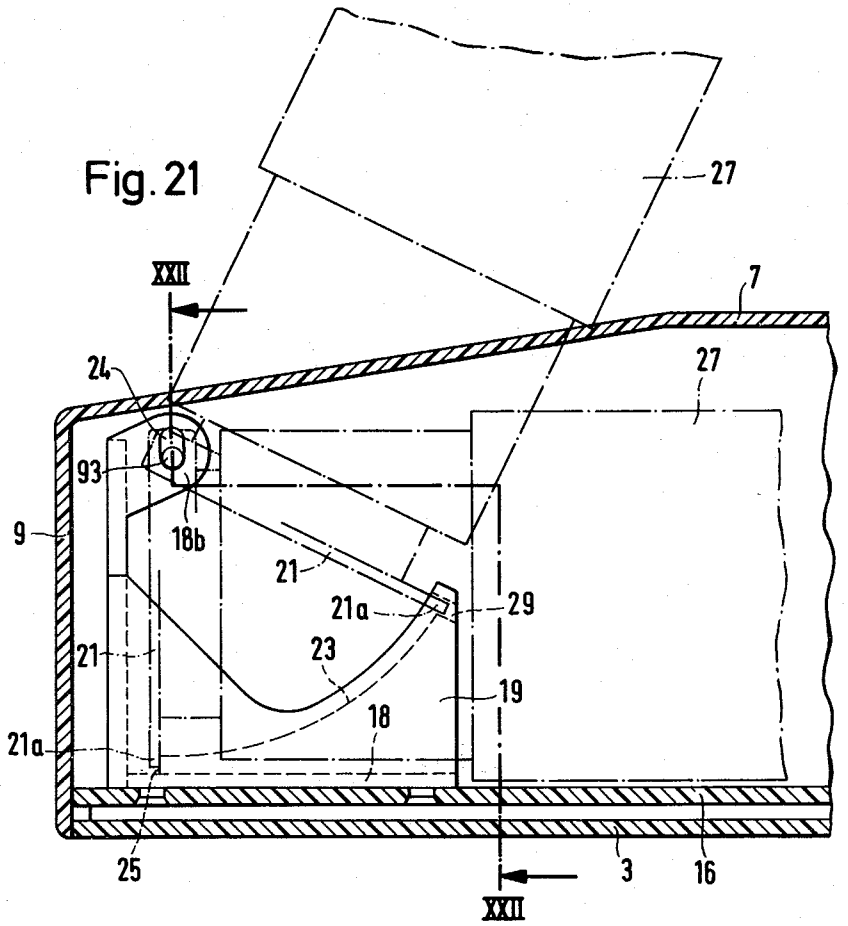

FIGS. 16 to 22 show a further modified lens holder, these being:

FIG. 16—the frame of the holder in side elevation;

FIG. 17—the frame in plan view from below;

FIG. 18—the frame in top plan view, with sectioned details;

FIG. 19 illustrates the associated pivotable plate with a holding ring in plan view; and FIG. 20 is a side elevational view of the plate of FIG. 19, partially sectioned;

FIG. 21 shows the lens holder assembled, viewed from the side; and

Figure 22:
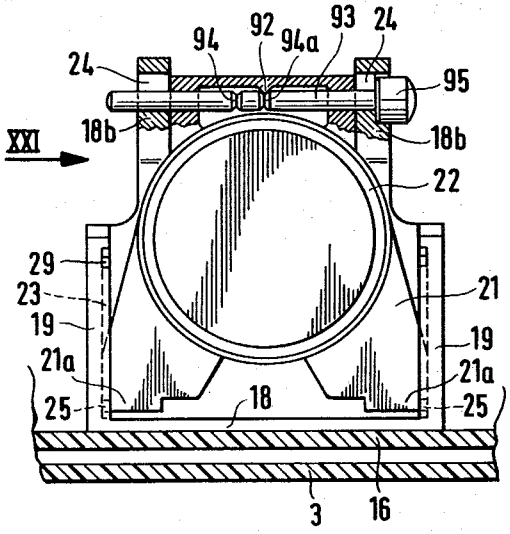

FIG. 22 is a sectional view taken in section along line XXII—XXII of FIG. 21.

Figure 23:
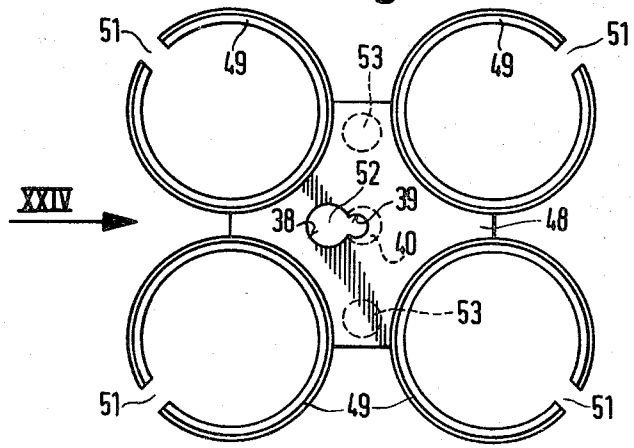

FIG. 23 illustrates a film holder for four film cases, which can be attached to the apertured mounting sheet of holes.

Figure 24:
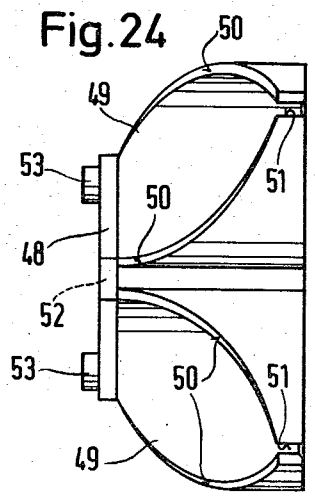

FIG. 24 illustrates the film holder of FIG. 23 in side view.

The photography case consists substantially of a main part 1 and a pivotal cover or lid 2.

The main case part has a rear wall 3, facing the body of the photographer when being carried, as well as two vertical side walls 4 and a horizontal base wall 5. The lid has a wall 7 defining the front of the photography case, two side walls 8 and an upper or top wall 9. The front wall 7 of the lid slopes inwardly and upwardly as illustrated.

The side walls 4 of the main part 1 and the side walls 8 of the lid 2 are complementary and together form the full width of the photography case. In the closed position, however, the edges of the side walls 8 on the lid 2 project over the side walls 4 on the case main part 1. At the lower outer corners of the side walls 8 on the lid 2 there are two hinge pins 9' which point inwardly towards each other. The hinge pins 9' each engage a guide groove 10 provided at the outer edge of each side wall 4 on the main case part 1. Each guide groove is closed off at its lower end having a locking projection 11 in the upper region, and then continues without interruption to the upper edge of the side wall in which disposed. While the side walls 4 define only half of the width of the case, the base wall 5 which is a part of the main part 1, extends substantially over the full case width extending to the front wall 7. Similarly the upper case wall 9 is an integral part of the lid 2. Two slotted tongues 12 engage in a lock box 13 provided on the upper edge of the main part 1, and are locked therein in a manner known per se. The locks or lock can, however, also be fitted to the lid and the tongue or tongues may be attached to the main case part 1.

Figure 2:
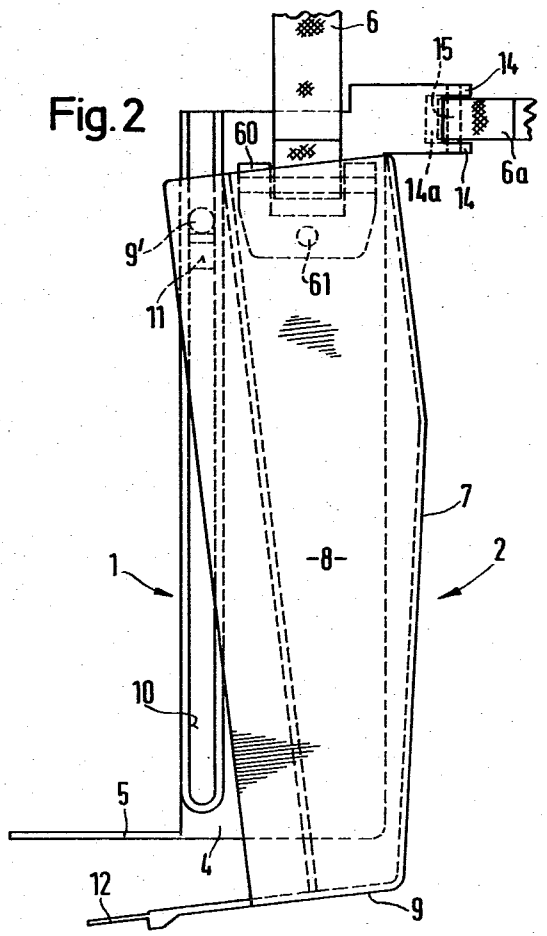
FIG. 2 shows the photography case in a side elevation, open, with the cover or lid nested over the main case part.

When opening the case, the lid 2 is pivoted around the pivot pins 9' through approximately 180°, and then hangs downwardly. The entire inner volume of the photography case is then accessible to the hand of the photographer. Furthermore, the individual items are releasably held on the walls of the main part, preferably on the rear wall, as will be explained in more detail later. From this position hanging down, the lid can now be pivoted behind the main part 1 into the "ready" position shown in FIG. 2, the hinge pins 9' being guided in the grooves 10 until in the fixed position of FIG. 2 by being elastically sprung behind the locking projections 11. The lid 2 is now out of the way and in particular the entire inner volume of the photography case and its contents are readily accessible to the photographer. However, due to the guide grooves 10 which are opened at the top, the lid can also be removed from case portion 1 and laid on one side.

A carrying strap 6 is attached to the upper region of the side walls 4, this being by means of a fitting 60 which is rotatable around a hinge pin 61 extending perpendicularly to the side wall 4, thus pointing straight out in the viewing direction of the case carrier. In this way, the carrying strap 6 can always adjust itself into the correct angular position relative to the case, irrespective of which shoulder the case is being carried over.

Another waist strap 6*a*, which is wound around the middle of the body of the case bearer or carrier, like a belt, is attached via corresponding attaching pins 15 laterally on the rear wall so that the photography case is, therefore, held securely in position, resting against the body of the carrier.

Furthermore, on the upper edge of the rear wall there is a rib 14 (see FIG. 5*a*) which is arched inwardly and which rests against the hip of the carrier conforming to the contours of his body. On each of the projecting terminal regions of the rib 14 each pin 15 is secured in its associated recess 14*a*, the waist strap 6*a* being drawn through behind these pins. When the waist strap is stretched taut it rests at the two contact points B against the hip and can be adjusted between these two contact points to suit the shape of the individual body as well as possible (see FIG. 5).

The suspension of the case on the body of the photographer is such that the lower region of the rear wall 3 projects obliquely outwards, and, therefore, it does not rub against his thigh during walking. In order to hold the case as simply as possible in this oblique position, the correct position of the hinge pins 61 is of paramount importance, and thus the attachment points of the carrying strap 6 on each side wall 4 relative to the center of gravity SP of the loaded case. Furthermore, the hinge pins 61 are offset laterally on the outside relative to the center of gravity SP towards the lid. Since, as is known in FIG. 5*b*, the center of gravity always lies vertically under the point of suspension, in this way the case and, therefore, the rear wall with it, pivots into the desired oblique position projecting out from the body of the photographer. The hinge pins 61 may also be attached underneath the waist strap 6*a*. When the waist strap 6*a* is put on, the case resting on the hip of the carrier can pivot around the hinge pins 61 into the desired oblique position, which is already achieved, however, by the above-mentioned arrangement of the hinge pins 61 relative to the center of gravity SP (see FIGS. 5, 5*b*).

For the releasable "plug-in" type connection of the individual photography items or their holders, an apertured sheet 16 is provided on the inner surface of the rear wall 3 and is apertured according to a specific grid pattern over almost all its surface, and rests against the rear wall 3 via spacer strips or stiffening bars 17 formed on its rear face (FIG. 6).

Connecting elements or securing means co-act with the sheet holes. These elements are expediently not attached to the relevant photographic accessories, but to special fixtures or holders therefor. The lenses, film cases or the like are thus attached releasably to these holders or fixtures, which are secured in turn on the perforated sheet 16. These holders or fixtures can be attached at random points on the rear wall.

For the attachment of the holders to the perforated sheet 16 a special eccentric pin is used in conjunction with a suitable shaping of the hole in which received.

As shown in FIGS. 7, 8 eccentric pin 33 has a shaft 34, on the free end of which a slit head 35 is provided, and on the other end of which there is an eccentric arm 36. The shaft 34 extends through the superimposed holes of the parts to be connected together; in the rotated position the eccentric arm 36 engages behind the edge of a hole 41 in the sheet 16, while the slit head 35 rests against the edge of the hole in the item which is to be connected, for example, the illustrated holder element 37.

The hole in the holder 37 comprises a larger circle 38 and a smaller circle 39 which partly overlaps it (FIG. 9). The diameter of the larger opening 38, like that of the holes in the apertured sheet 16, corresponds to the size of the eccentric arm 36, while the diameter of the smaller circle 39, on the other hand, corresponds to the diameter of the shaft portion 34. At the sickle-shaped edge of the smaller circle 39 which is furthest from the larger circle 38 there is a collar 40 which fits in a hole 41 in the perforated sheet 16 (FIGS. 9, 10).

During assembly, the eccentric arm 36 is "plugged-in" or inserted through the larger hole 38 on the holder 37, and then the shaft 34 is pushed into the small circular hole 39. The eccentric arm 36 is then rotated into a concentric position via the collar 40 and is then pushed into a hole 41 in the sheet 16, the collar 40 also entering into the hole. The assembly shown in FIG. 7 results. By means of a screwdriver, the pin 33 can now be rotated so that its eccentric arm 36 engages behind the inner edge of the hole 41 in the sheet 16, while the lower face of the slit head 35 is simultaneously pressed against the edge of the circular hole 39 in the holder 37. Furthermore, the eccentric arm 36 has a chamfer 43 which co-acts with the chamfered inner edge 44 of the hole 41 (FIG. 8).

By means of an annular groove 47 running around the lower face, or also by means of a concave arching of the lower face of the slit head 35, a sprung shank 45 is provided, which further preferably projects axially above the lower face. The slit head 35 is supported via this sprung shank 45 on the edge of the hole in the holder 37. At the circumferential region which overlaps the larger circle 38, this being at the two edges, the sprung shank 45 is deformed; the edges therefore intersect or are pressed into the sprung shank 45 so that the pin 33 is secured against accidental rotation, and thus release (compare FIG. 8, where the sprung shank 45 has entered into the hole 38).

The position of the eccentric arm 36 is expediently indicated by a marking on the slit head 35.

The small circular hole 39 extends over more than 180°, so that the shaft 34 can be sprung-snapped securely in the circular hole 39.

Instead of the above-described "plug-in" type connection with the eccentric pin according to FIGS. 7 to 10, a "plug-in" connection can be provided by means of a rotatable clamping pin as shown in FIGS. 11 and 12 (or 13).

On each holder or fixture 37*a* there are two half-shells 66 separated from each other by a slit 65, which can be plugged into a hole 41 in the apertured sheet 16 and can each engage over the inner edge of the hole via a collar 67. A clamping pin 64 equipped with a slit head fits in the hole or in the recess between the two half-shells 66 and has at its lower inner end two diametrically opposed wings or cams 68. In the pushed-in position (FIG. 11) the pin can be pushed via the cams 68 into the recess between the half-shells 66; if the clamping pin 64 is then rotated through approximately 90° (FIG. 12) the cams 68 come to rest against the collars 67 and spread these apart so that now the collars 67 engage behind the inner edge of the hole 41 in the sheet 16 via each shoulder 69 so that the holder or fixture 37*a* is locked on the sheet 16.

The front edge of the collar 67 is chamfered at 69*a* to make pin insertion easier. The shoulder 69 is formed with a slope so that it rests smoothly on the edge of the hole in the sheet 16 when in the clamping position (FIG. 12).

FIG. 13 shows a clamping pin 70 with only one clamping cam 71 which projects to one side, and which is provided on its upper face with an inwardly and downwardly surface or run-in slope 72. In the clamping position this clamping cam 71 co-acts via the run-in slope 72 with a corresponding hook part provided on the holder part 37*a* see (FIGS. 11–12). This hook part can be inserted together with the clamping pin 70 in a hole of the sheet 16 and engages behind the inner edge of the hole in the clamping position similar to that illustrated in FIG. 12.

Figure 13B:
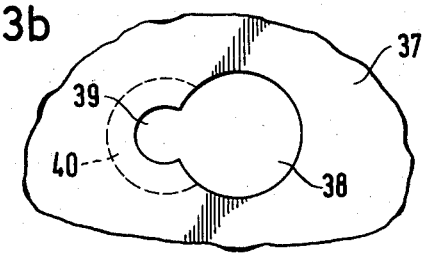
Figure 13C:
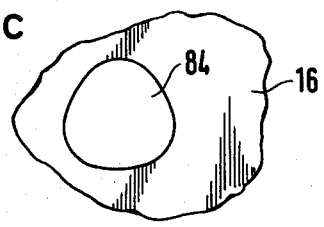

The "plug-in" connection of the various fixtures and holders in the apertured plate 16 may, however, also be effected with a screw element; such an embodiment is shown in FIGS. 13*a*, 13*b*, 13*c*.

FIG. 13*a* illustrates a section through such a connection.

FIG. 13*b* illustrates the hole configuration in the part to be attached, for example, a holder 37, in plan view;

FIG. 13*c* also shows in plan view a noncircular hole in the apertured sheet 16.

The hole in the holder 37 is again made up from a larger circular recess portion 38 and a smaller recess portion 39. The threaded section 81 of the screw 82 can be inserted through the larger hole 38 and the upper section 83 of the shaft, the diameter of which tapers, is locked in the smaller hole area 39. The head of the screw may preferably also be inserted through the larger hole section 38 so that the screw 82 does not have to be screwed right out for changing. On the smaller hole part 39 a centering collar 40 is again provided; this engages in the receiving opening 84 in the sheet 16. The thread 81 of the screw 82 is self-tapping, and thus constructed as a thread-cutter. The holes 84 in the perforated sheet 16 are noncircular and are made up from three identical curved sections. The hole is thus in the shape of a rounded triangle. When the screw is screwed in, material from the narrower parts of the hole are forced into the wider parts of the hole. The screw is rounded off at its distal point as seen in FIG. 13*a* in order to avoid scratching. The hole 84 in the sheet 16 is slightly concial in vertical section corresponding to the thread section of the screw.

FIGS. 14 and 15 show a special holder device for a spare lens. This holder device has a substantially vertical shank 18, a horizontal arm or shank 18*a* provided on its upper edge and two gussets 19 extending in between. On the free ends of the gussets 19 a plate 21 is articulated by means of hinge pins 20 and has provided on it a holder ring 22 with a screw-in thread for a lens. The pins 20 each engage in an elongated slot 24 in the plate 21. The plate 21 is guided via its two lower corners 21*a* along a circular guideway 23 provided on the inner face of the gussets 19, and concentric to the pivot pins 20.

In the rest position shown in FIG. 14 the plate 21 and with it the holder 22 are pivoted upwards into the horizontal position parallel under the horizontal arm 18*a* of the holder, and pushed towards the rear along the elongate slot 24, the front edge or the corners 21*a* of the plate 21 being locked thereby in a recess or stop 25 provided on the holder; the lens 27 is thus held in the vertical position. Although this vertical position is favorable for space-saving transportation, for lens insertion and removal, this position would not be favorable. The lens 27, together with the holder 22, 21, is thus able to pivot into the oblique position shown in FIG. 15. The lens (or the holding ring) is grasped, and the holding ring is firstly pushed horizontally in the direction of the elongate slot 24, so that its rear lower edge or corners 21*a* are released from the stop 25, and the holder can now be displaced along the guideway 23; in the desired oblique position the holding plate 21 is then locked via its corners 21*a* in the stops or recesses or catches 29 in the gussets 19.

So that the holding plate 21 cannot accidentally slip forwards along the elongated hole 24, whereby its rear corners 22 would be released from their locked position, a lock 30 can be pivoted towards the front into the movement path in front of the holding plate 21. The holder 21, 22 also serves as a dust cover.

The horizontal shank 18*a* of the holder is equipped with a grid of holes 41 corresponding to the apertures of sheet 16, in which thus a further fixing or even a small box for small items may be attached by means of an eccentric pin or a clamping pin.

This pivotable lens holder is rather important to the invention, and a further, partially improved embodiment of it is shown in FIGS. 16 to 22. The basic construction and operating method corresponds with that of the embodiment shown in FIGS. 14, 15, to which reference will, therefore, be made; similar parts are given the same reference numerals in FIGS. 16 to 22.

According to FIGS. 14, 15 the pivotable plate 21 with the lens holding ring 22 is hinged by means of simple pins or rods 20 at the lower front on the horizontal arm 18*a* of the basic frame, and may be displaced via the elongate slot 24, either to lock it in the transporting position (front corners 21*a* of the plate 21 lock in stops or catches 25 on the upper end of the vertical shank 18 of the basic frame) or in the oblique position sloping downwardly for changing the lens cover (corners 21*a* of the plate 21 being locked in catches 19 on the end of the circular guideways 23 on the gussets 19).

According to FIGS. 16 to 22 on the other hand, instead of the simple pins 20 there is a special pin 93 (FIG. 22) and a special hole shape co-acting therewith on the upper end of the pivoting plate 21 and on the two bearings 18*b* projecting from the horizontal arm 18*a*.

These bearings again have the elongate slot 24; however, in addition on at least one of the two bearings there is a circular recess 90 (FIG. 16) with a slightly larger diameter than the length of the elongate slot 24. The pivot plate 21 has on its upper end two holes 91 (FIG. 19) for the pivot pins and, between these, a protruding locking projection 92. The pin 93 which forms the pivot axis has on its shaft two locking grooves 94, 94*a* for the locking projection 92, and on one of its ends a head 95 for the recess 90 on one of the bearings 18*b*.

With this design, the assembly and function are as follows. The basic frame of the lens holder is again attached to the plate 16 by means of the eccentric securing components above described. Then the pivotable plate 21 is inserted in the basic frame in such a way that its lower sliding edges or corners 21*a* are located in one of the two terminal pivoting positions, and the holes 91 on its upper ends align with the holes 24, 90 in the bearings 18*b*. Now the bearing pin 93 is inserted from the side through these four holes until the locking projection 92 or locking cam locks in its first locking groove 94. In this locked position of the pin 93, the pivotable plate 21 can be pushed or lifted out of the two terminal pivoting positions, the ends of the shaft of the pin 93 being displaced in the elongate slots 24. The head 95 of the pin is now located outside the recess 90 on one of the bearings 18*b*. If now the bearing pin 93 is pushed in further up to its second locking groove 94*a*, its head 95 dips into the hole 90 with the larger diameter adapted thereto, which as stated is provided in front of the elongated hole 24 in at least one of the bearings 18*b*. The pivotable plate 21 is either inserted via its locking corners 21*a* in the lower catch 29 or in the upper catch 25 and is locked in one of these terminal pivoting positions by means of the pin head 95. For unlocking, for the purpose of pivoting into the other position, the process is reversed, i.e., the pin head 95 is withdrawn from the recess 90, the pivoting plate 21 is then pushed out of the relevant catch 25 or 29 and pushed along the guideway 23 into the other catch 29 or 25 again, the pin head 95 again being locked in its recess 90 on one of the bearings 18*b*.

With the hole—eccentric pin connection (FIGS. 7 and 10) or the clamping pin connection (FIGS. 11 to 13) or the connection with the screw pin (FIGS. 13*a, b, c*) any items equipped with suitable "plugging" holes can be attached. Furthermore, this kind of attachment can also be used outside a photography case. For example, such a perforated sheet can be set up in a shop window or display case in a photographic shop, for instance, the articles which are to be put on show then being attached releasably on the apertured sheet by means of the described securing device.

FIGS. 23, 24 show a holder for film cases which can be attached in this way to the perforated wall. At the corners of a holding plate 48, perpendicular thereto there are four substantially cylindrical cases 39 which each have an obliquely cut-away edge 50 at the base, continuing into a slit 51 so that the holder cases 49 are made elastic and film cases of a corresponding diameter can easily be inserted and removed. The fourfold film holder is attached to the perforated sheet 16 by means of a hole 52. At least one pin 53 attached to the lower face of the fixing plate engages in an adjacent hole in the apertured sheet 16. By means of such a locating pin 53 the holder concerned is aligned in a correct angular position relative to the apertured sheet 16.

This application is related to my commonly owned application Ser. No. 68992 entitled Bag Construction filed Aug. 23, 1979, the contents of which are incorporated herein by reference.

It is thus seen that a novel case construction has been provided in which discrete photographic elements may be positioned in place directly, or by means of holders, on an apertured wall surface by novel, releasable securing means. It is believed that the various modifications of securing elements object holders, apertures, etc., above disclosed have made apparent a number of variations of the inventive concept disclosed. This invention is to be limited, therefore, only by the scope of the appended claims.

What is claimed is:

1. A photography case construction comprising plurality of wall portions defining the periphery of said case and an enclosed case interior for receiving a plurality of discrete photographic items, an inner mounting wall of said case interior having apertures therein; securing means received in the apertures of said mounting wall for releasably securing a photographic item in place on said mounting wall; each of said securing means comprising a pin having an enlarged head, a shank portion extending therefrom adapted to traverse the thickness of said apertured wall, and a terminal eccentric arm oppositely disposed to said enlarged head projecting outwardly from said shank portion; said securing means head and eccentric arm being adapted to engage opposite surfaces defining an aperture through which said pin shank portion extends.

2. The photography case of claim 1 wherein the pin head is slotted and has an elastic sprung edge, owing to a slot in its lower face.

3. The photography case of claim 1 in combination with a lens holder having an apertured anchor portion detachably secured to said wall by a securing means; the lens holder comprising a plate with a holding ring having screw-in threads; said lens holder plate being pivotally mounted on said anchor portion.

4. A photography case according to claim 3 wherein the anchor portion comprises a frame with a horizontal arm having slotted portions for supporting said plate; a pin traversing spaced apertured portions of said plate and received in said arm slotted portions for mounting said plate on said arm; said plate having two corner portions which lie opposite to the pin axis and which are guided on curved guide tracks concentric with said pin and formed on the anchor portion on two side gussets thereof; recesses formed in the upper ends of the guide tracks under the horizontal arm which face the mounting wall, and in the lower outer ends of the guide tracks for locking said plate in a pivoted-in storage position and a pivoted-out position for changing the lens, respectively.

5. A photography case according to claim 4 wherein the horizontal arm extends perpendicularly from the apertured wall, possesses holes corresponding to the apertures of said wall for attaching objects by means of securing means.

6. A photography case according to claim 4 wherein a locking bar is attached to the end of at least one of the gussets of the anchor portion, and is able to be pivoted or moved in front of the holding plate in the storage position for preventing movement thereof disengaging said pin from said arm slotted portions.

7. A photography case according to claim 4 wherein said pin has an enlarged head at one end of a shaft portion and two locking grooves are formed on its shaft portion; wherein the plate between its spaced apertured portions has a locking projection for locking in one of the said grooves, and wherein on at least one pin-receiving apertured portion on the horizontal arm of the anchor portion is provided with a recess for receiving said enlarged head.

8. A photography case construction comprising plurality of wall portions defining the periphery of said case and an enclosed case interior for receiving a plurality of discrete photographic items, an inner mounting wall of said case interior having apertures therein; securing means received in the apertures of said mounting wall for releasably securing a photographic item in place on said mounting wall; an apertured item to be secured by said securing means to said mounting wall, such aperture of said item comprising two intersecting circles of dissimilar diameter; the larger diameter circle having a diameter permitting passage therethrough of the securing means eccentric arm, and the smaller circle having a diameter corresponding to the diameter of the securing means shank portion.

9. The photography case of claim 8 in which the edge of the smaller circle disposed furthest from the larger circle has projecting therefrom a substantially sickle-shaped collar portion for interfitting with an aperture in the apertured wall.

10. A photography case according to claim 8 wherein a locating pin projects from said item which is to be attached to the apertured wall and fits in an aperture of said wall in the secured position.

11. A photography case construction comprising plurality of wall portions defining the periphery of said case and an enclosed case interior for receiving a plurality of discrete photographic items, an inner mounting wall of said case interior having apertures therein; securing means received in the apertures of said mounting wall for releasably securing a photographic item in place of said mounting wall; said case comprising a main case portion on which said mounting wall is interiorly mounted, and a lid pivotally mounted on pivot pins; said case main portion having opposed side walls with grooves disposed in outer distal edge surfaces thereof; said pivot pins being received in said grooves.

12. The photography case of claim 11 wherein said lid may be detached from said main case portion and nestably disposed behind said main case portion whereby said mounting wall of said main case portion is exposed; and supports are disposed in upper portions of said grooves for supporting said lid pivot pins when said lid is in the nested position.

13. A photography case construction comprising plurality of wall portions defining the periphery of said case and an enclosed case interior for receiving a plurality of discrete photographic items, an inner mounting wall of said case interior having apertures therein; securing means received in the apertures of said mounting wall for releasably securing a photographic item in place on said mounting wall; the portion of the mounting wall defining the peripheral edge of each aperture in the mounting wall being chamfered.

14. A photography case construction comprising plurality of wall portions defining the periphery of said case and an enclosed case interior for receiving a plurality of discrete photographic items, an inner mounting wall of said case interior having apertures therein; securing means received in the apertures of said mounting wall for releasably securing a photographic item in place on said mounting wall; said securing means having on its lower portion a self-tapping threaded section for tapping into an aperture of the apertured mounting wall.

15. A photography case construction comprising plurality of wall portions defining the periphery of said case and an enclosed case interior for receiving a plurality of discrete photographic items, an inner mounting wall of said case interior having apertures therein; securing means received in the apertures of said mounting wall for releasably securing a photographic item in place on said mounting wall; an apertured holder for a photographic item having an anchor portion for depending into a mounting wall aperture and extending beneath a bottom peripheral wall surface portion defining said aperture; said securing means including a shank portion extending into said aperture from an enlarged head supportingly disposed on a top wall surface opposed to said bottom surface portion, said shank being integrally formed with an outwardly projecting cam surface for engaging said anchor portion and wedging the same to said wall bottom surface portion.

16. The photography case of claim 15 wherein said projecting cam surface is relieved for engagement of a hook projection on said holder anchor portion.

* * * * *